US008827475B2

(12) United States Patent
Parker et al.

(10) Patent No.: US 8,827,475 B2
(45) Date of Patent: Sep. 9, 2014

(54) LIGHT BULB WITH ADJUSTABLE LIGHT SOURCE

(75) Inventors: Jeffery R Parker, Richfield, OH (US); Timothy A McCollum, Avon Lake, OH (US); Fumitomo Hide, San Jose, CA (US); Alexey Titov, Sagamore Hills, OH (US); Ian Hardcastle, Sunnyvale, CA (US)

(73) Assignee: Rambus Delaware LLC, Brecksville, OH (US)

( * ) Notice: Subject to any disclaimer, the term of this patent is extended or adjusted under 35 U.S.C. 154(b) by 0 days.

(21) Appl. No.: 13/421,105

(22) Filed: Mar. 15, 2012

(65) Prior Publication Data

US 2012/0236535 A1 Sep. 20, 2012

Related U.S. Application Data

(60) Provisional application No. 61/453,753, filed on Mar. 17, 2011, provisional application No. 61/454,203, filed on Mar. 18, 2011.

(51) Int. Cl.

| | |
|---|---|
| ***F21V 9/10*** | (2006.01) |
| ***F21V 9/16*** | (2006.01) |
| ***F21K 99/00*** | (2010.01) |
| *F21Y 101/02* | (2006.01) |

(52) U.S. Cl.

CPC ... *F21K 9/13* (2013.01); *F21V 9/16* (2013.01); *F21K 9/52* (2013.01); *F21K 9/58* (2013.01); *F21V 9/10* (2013.01); *F21Y 2101/02* (2013.01); *F21K 9/56* (2013.01)

USPC ..... 362/84; 362/293; 362/583

(58) Field of Classification Search

CPC ..... F21V 1/702; F21V 9/02; F21V 9/00; F21V 1/00; F21V 14/08; F21K 9/13; F21K 9/52; F21K 9/56; F21K 9/58

USPC ..... 362/84, 293, 583, 277, 311.02, 311.03, 362/582; 359/888–889

See application file for complete search history.

(56) References Cited

U.S. PATENT DOCUMENTS 2,681,946 A 6/1954 Leverenz
4,382,272 A * 5/1983 Quella et al. ..... 362/84

(Continued)

FOREIGN PATENT DOCUMENTS

JP 2005222750 8/2005

OTHER PUBLICATIONS

Jesse Hora Dot Com "How to Prepare Artwork for Screen-Printing", Jul. 21, 2009.*

(Continued)

*Primary Examiner* — Diane Lee
*Assistant Examiner* — Naomi M Wolford
(74) *Attorney, Agent, or Firm* — Renner, Otto, Boisselle & Sklar, LLP

(57) ABSTRACT

A light bulb includes a base for mechanically mounting the light bulb and for receiving electrical power, a light guide, and a light source that directs output light into the light guide. The light source includes a light emitting device that emits light, and a variable spectrum adjuster that is variably positionable relative the light path of light emitted by the light emitting device. The spectrum adjuster includes a region of continuously-variable spectrum-adjusting material, usable for adjusting the spectrum of light passing through the spectrum adjuster. In some embodiments, the spectrum adjusting material is a color-attenuating material, such as a filtering material. In other embodiments, the spectrum-adjusting material is a wavelength-shifting material, such as a phosphor, or another suitable type of material that shifts the wavelength of light incident.

33 Claims, 15 Drawing Sheets

(56) References Cited

U.S. PATENT DOCUMENTS

| | | | | |
|---|---|---|---|---|
| 4,890,208 | A | 12/1989 | Izenour | |
| 4,894,760 | A | 1/1990 | Callahan | |
| 4,914,556 | A | 4/1990 | Richardson | |
| 5,136,480 | A | 8/1992 | Pristash | 362/31 |
| 5,825,458 | A * | 10/1998 | Cooper | 351/203 |
| 5,825,548 | A | 10/1998 | Bornhorst et al. | |
| 6,528,937 | B1 | 3/2003 | Van Gorkom | 313/485 |
| 7,161,313 | B2 | 1/2007 | Piepgras et al. | 315/318 |
| 7,223,007 | B1 | 5/2007 | Fredley et al. | 362/616 |
| 7,331,681 | B2 | 2/2008 | Pohlert et al. | 362/18 |
| 7,547,114 | B2 | 6/2009 | Li et al. | |
| 7,651,243 | B2 | 1/2010 | McGuire, Jr. et al. | 362/293 |
| 7,663,733 | B2 | 2/2010 | Glent-Madsen et al. | 355/53 |
| 7,665,865 | B1 | 2/2010 | Hulse et al. | 362/277 |
| 7,806,538 | B2 | 10/2010 | Ajiki et al. | 362/19 |
| 7,902,560 | B2 | 3/2011 | Bierhuizen et al. | |
| 2003/0021117 | A1 * | 1/2003 | Chan | 362/260 |
| 2007/0236933 | A1 | 10/2007 | Bierhuizen et al. | |
| 2007/0263388 | A1 | 11/2007 | Lai et al. | 362/287 |
| 2008/0142816 | A1 | 6/2008 | Bierhuizen et al. | |
| 2009/0086475 | A1 | 4/2009 | Caruso et al. | |
| 2009/0091915 | A1 * | 4/2009 | Eriksson | 362/84 |
| 2009/0103293 | A1 * | 4/2009 | Harbers et al. | 362/231 |
| 2009/0187234 | A1 | 7/2009 | Meyer et al. | |
| 2010/0033948 | A1 * | 2/2010 | Harbers et al. | 362/84 |
| 2010/0046076 | A1 | 2/2010 | Feke et al. | |
| 2010/0148650 | A1 * | 6/2010 | Wu et al. | 313/1 |
| 2010/0246158 | A1 | 9/2010 | Van Gorkom et al. | 362/19 |
| 2010/0315810 | A1 | 12/2010 | Tseng | 362/234 |
| 2010/0321931 | A1 | 12/2010 | McDermott | 362/190 |
| 2011/0234076 | A1 | 9/2011 | Simon et al. | |

OTHER PUBLICATIONS

International Search Report and Written Opinion from corresponding International Application No. PCT/US12/29196.

* cited by examiner

LIGHT BULB WITH ADJUSTABLE LIGHT SOURCE

RELATED APPLICATION DATA

This application claims the benefit of U.S. Provisional Application No. 61/453,753, filed Mar. 17, 2011 and claims the benefit of U.S. Provisional Patent Application No. 61/454,203, filed Mar. 18, 2011, which is incorporated by reference in its entirety.

BACKGROUND

Light sources have long been used to provide various sorts of illumination for various purposes. Different types of light sources can provide different moods, and can be used for different purposes. For example the results in photography are highly dependent on the amount and type of illumination. It is desirable to increase versatility in light sources, and in devices that include light sources.

BRIEF DESCRIPTION OF THE DRAWINGS

The annexed drawings are not necessarily to scale.

DETAILED DESCRIPTION

A light bulb includes a base for mechanically mounting the light bulb and for receiving electrical power, a light guide, and a light source that directs output light into the light guide. The light source includes a light emitting device that emits light, and a variable spectrum adjuster that is variably positionable relative the light path of light emitted by the light emitting device. The spectrum adjuster includes a region of continuously-variable spectrum-adjusting material, usable for adjusting the spectrum of light passing through the spectrum adjuster. In some embodiments, the spectrum adjusting material is a color-attenuating material, such as a filtering material. In other embodiments, the spectrum-adjusting material is a wavelength-shifting material, such as a phosphor, or another suitable type of material that shifts the wavelength of light incident thereon. As a result, the light emitted by the light source has an adjustable spectrum.

Figure 1:
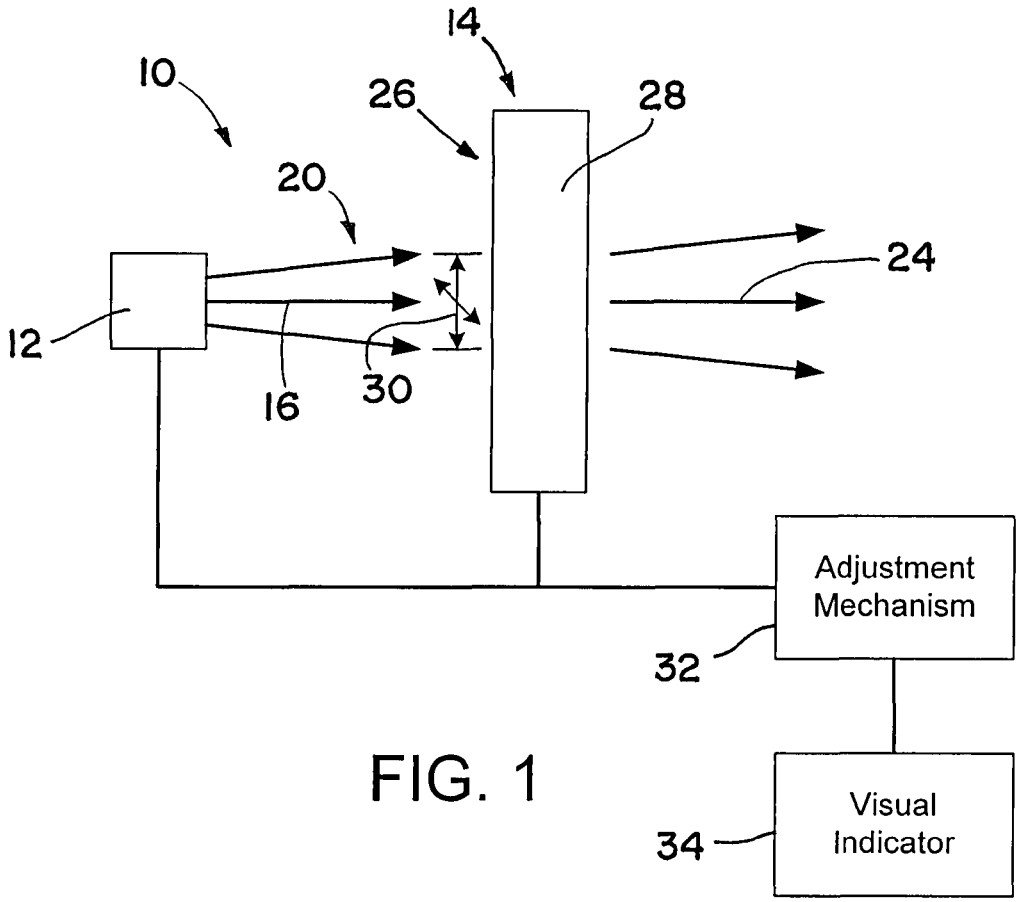
FIG. 1 is a schematic side view of a first light source.

FIG. 1 shows an example of a light source 10 that generates light having a variable spectrum. The light source 10 includes a light emitting device 12, and a variable spectrum adjuster 14. The light emitting device 12 emits light 16 along a light path 20. The spectrum adjuster 14 and the light path 20 are variably positionable relative to one another. The spectrum adjuster 14 includes a spectrum-adjusting region 26 that includes a spectrum-adjusting material 28 that has a continuously varying spectrum-adjusting property having a local value that depends on position in the spectrum-adjusting region 26. Typically the spectrum-adjusting region 26 has dimensions greater than the cross-sectional dimensions 30 of the light path 20 at the spectrum adjuster 14. The relative positioning of the spectrum adjuster 14 and the light path 20 determines the position at which the light 16 is incident on the spectrum adjuster 14. The position at which the light 16 is incident on the spectrum adjuster in turn determines the local value of the spectrum-adjusting property to which the incident light is subject. The local value of the spectrum-adjusting property of the spectrum adjuster 14 determines at least in part the spectrum of output light 24 output by the light source 10. Changing the relative positioning of the spectrum adjuster 14 and light path 20 changes the position at which light 16 is incident on the spectrum adjuster 14, and hence subjects the light 16 to a different local value of the spectrum-adjusting property of the spectrum adjuster 14. This changes the spectrum of the output light 24.

In some embodiments, the relative positioning of spectrum adjuster 14 and the light path 20 is varied by changing the relative positioning of the light emitting device 12 and the spectrum adjuster 14. Other ways of varying the relative positioning of spectrum adjuster 14 and the light path 20 are possible and may be used. For example, the position of a mirror located part-way along the light path may be moved to vary the relative positioning of the spectrum adjuster 14 and the light path 20. Adjusting the relative positioning of the spectrum adjuster 14 and the light path 20 provides a defined continuously-variable adjustment of the spectrum of the light 16 passing through the spectrum adjuster 14 and, hence a corresponding variation of the spectrum of the output light 24 output from the light source 10. Adjustment of the spectrum of a light source is advantageous in that it allows the production of light of different spectra, such as different colors or different color temperatures, for different purposes, and/or for different visual effects. In different embodiments, varying the relative positioning of the spectrum adjuster 14 and the light path 20 involves movement of the light emitting device 12, movement of the spectrum adjuster 14, or movement of both the light emitting device 12 and the spectrum adjuster 14. These and other possibilities are alternatives to moving the spectrum adjuster in the embodiments described below.

The relative positioning of the light emitting device 12 and spectrum adjuster 14 is variable through use of an adjustment mechanism 32. The adjustment mechanism 32 may include any of a variety of electrical, mechanical, or other elements for effecting a relative positional change of the spectrum adjuster 14 and the light path 20. Examples of such elements are motors, actuators, gears and belts. In one example, after adjustment, the relative positioning is fixed during manufacture of the light source 10, or a device containing the light source 10. In one example, the amount of relative positioning is limited by stops (not illustrated). Other manually-operated mechanisms are possible. For instance, types of sliders may be employed or a turnable knob may act on a moveable component through a gear or drive train. In other embodiments, the adjustment mechanism 32 is motorized to move one or both of the light emitting device 12 and/or spectrum adjuster 14 relative to the other. The motorized mechanism may be controlled by a control assembly (not shown) to adjust light output based on user input, feedback from sensors, or a triggering event. In another example, the adjustment mechanism 32 is controllable, either manually or automatically by a machine, such as a computer, or using a computer as an intermediate agent. The term "computer" should be understood broadly as encompassing all sorts of circuits, such as integrated circuits, used for performing general or specific tasks.

A visual indicator 34 is operatively coupled to the adjustment mechanism 32. The visual indicator 34 provides a user with a visual indication of the relative positioning of the spectrum adjuster 14 and the light path 20, and thus a visual indication of the adjustment of the spectrum of the light output from the light source 10.

The continuously-varying spectrum-adjusting property of the spectrum adjuster 14 is due to a continuously varying spectrum-adjusting property, such as thickness and/or density, of a spectrum-adjusting material 28. The spectrum-adjusting property may be a color-attenuating property of a color-attenuating material, such as selective color subtraction by filtering. As used herein, "color-attenuating" is meant to refer to preferentially attenuating light in a portion of the spectrum of the light (e.g., light of some colors) more than light in another portion of the spectrum (e.g., light of other colors). Specifically excluded from this definition are devices that attenuate light of all colors equally, an example being neutral density filters.

As an alternative to, or in addition to, color attenuation, the spectrum adjusting property may be a wavelength-shifting property of a wavelength-shifting material. Further details of these possibilities, and other variants and alternatives, are discussed in greater detail below.

The light emitting device 12 may be any of a variety of types of light emitting device for emitting light with any of various characteristics. Examples of types of light emitting device include lasers, incandescent light sources, gas discharge lamps, arc lamps, compact fluorescent lamps, halogen lamps, and solid state light emitting devices, such as light emitting diodes (LEDs), laser diodes, and organic LEDs (OLEDs). With regard to characteristics of the emitted light, examples of light emitting devices include broad-spectrum light emitting devices in the visible spectrum (e.g., "white light" light emitting devices), light emitting devices emitting light with no operably-effective intensity at wavelengths greater than 500 nm, and ultra-violet (UV) light emitting devices.

The spectrum adjuster 14 may have additional regions in addition to the spectrum-adjusting region 26. The additional regions may be additional spectrum-adjusting regions that have different spectrum-adjusting properties, for example having a continuously varying spectrum-adjusting property having a local value that depends on position in the additional spectrum-adjusting region. Alternatively or in addition, the additional regions may be non-spectrum-adjusting regions that do not provide any spectrum adjustment. An additional spectrum-adjusting region may be located adjacent the spectrum-adjusting region 26. Alternatively, a non-spectrum-adjusting region may be located between a pair of spectrum-adjusting regions. Another region may include a spectrum-adjusting material having a fixed spectrum-adjusting property that does not vary with position within the region.

The spectrum adjuster 14 is variably positionable relative to the light path 20 of the light 16 emitted by light emitting device 12 in any of a variety of suitable ways. In an example, the spectrum adjuster 14 is translated relative to the light path 20 in a single direction or in multiple directions. In another example, the spectrum adjuster 14 is rotatable about a suitable axis to align different parts of the spectrum-adjusting region 26 with the light path 20.

Once positioned, the relative positioning of the spectrum adjuster 14 and the light path 20 will remain unchanged until the user or control assembly makes a change to the relative positioning. Since constant motion of the spectrum adjuster 14 relative to the light path 20 is not contemplated during operation of the lighting source 10, the range of movement of the spectrum adjuster 14 and/or the light path 20 may be limited.

Figure 2:
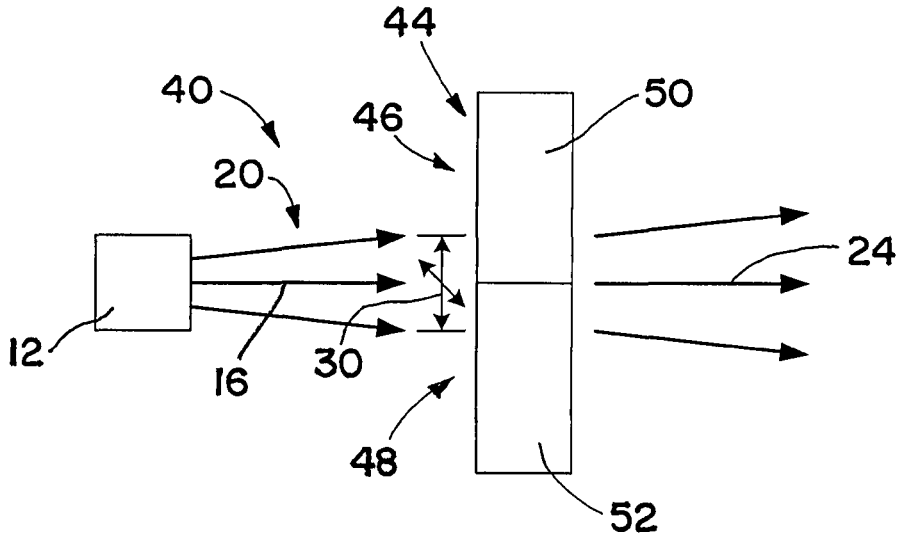
FIG. 2 is a schematic side view of a second light source.

FIG. 2 shows an example of a light source 40 that is similar to the light source 10 (FIG. 1) except that it utilizes a spectrum adjuster 44 that has two spectrum-adjusting regions 46 and 48 that include different spectrum-adjusting materials 50 and 52. The spectrum-adjusting materials 50 and 52 each provide a respective continuously-varying spectrum-adjusting property based on position in their respective spectrum-adjusting regions 46 and 48. Each of the spectrum-adjusting regions 46 and 48 has dimensions greater than the cross-sectional dimensions 30 of the light path 20, at the spectrum adjuster 44, of the light 16 emitted by the light emitting device 12.

The spectrum adjuster 44 is variably positionable relative to the light path 20 to change the spectrum of the output light 24 from the light source 40. The spectrum-adjusting materials 50 and 52 may be materials of the same kind, for producing different adjustments to the spectrum of the output light, or may be materials of different kinds, with one being a color-attenuating material, for example, and the other being a wavelength-shifting material, for example.

Figure 3:
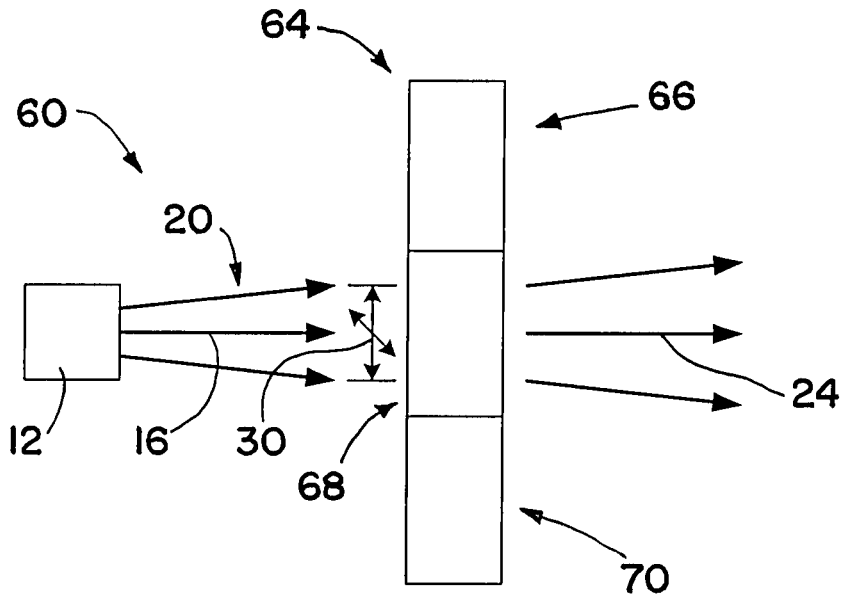
FIG. 3 is a schematic side view of a third light source.

FIG. 3 shows an example of a light source 60 that has a spectrum adjuster 64 that has three regions 66, 68, and 70. Similar to the light sources 10 and 40 of FIGS. 1 and 2, the light emitting device 12 emits light 16 along a light path 20. The light 16 is incident on a portion of the spectrum adjuster 64. The spectrum adjuster 64 and the light path 20 are variably positionable relative to one another to adjust the spectrum of the output light 24 from the light source 60.

The regions 66 and 70 are spectrum-adjusting regions, and function similarly to the spectrum-adjusting regions 46 and 48 of the light source 40 (FIG. 2). The region 68 is a non-spectrum-adjusting region and is located between the spectrum-adjusting regions 66 and 70. The non-spectrum-adjusting region 68 contains no operably-effective amount of spectrum-adjusting material. The non-spectrum-adjusting region 68 has dimensions greater than the cross-sectional dimensions 30 of the light path 20 at the spectrum adjuster 64. Alternatively the non-spectrum-adjusting region 68 may have dimensions less than the cross-sectional dimensions 30 of the light path 20.

The spectrum adjuster 64 and the light path 20 are variably positionable relative to one another to place in the light path 20 a portion of the spectrum-adjusting region 66, a portion of the spectrum-adjusting region 70, a portion of the non-spectrum-adjusting region 68, or some combination of a portion of the non-spectrum-adjusting region 68 and a portion of either of the spectrum-adjusting regions 66 and 70. This allows for a broad range of adjustment of the spectrum of the output light 24.

Figure 4A:
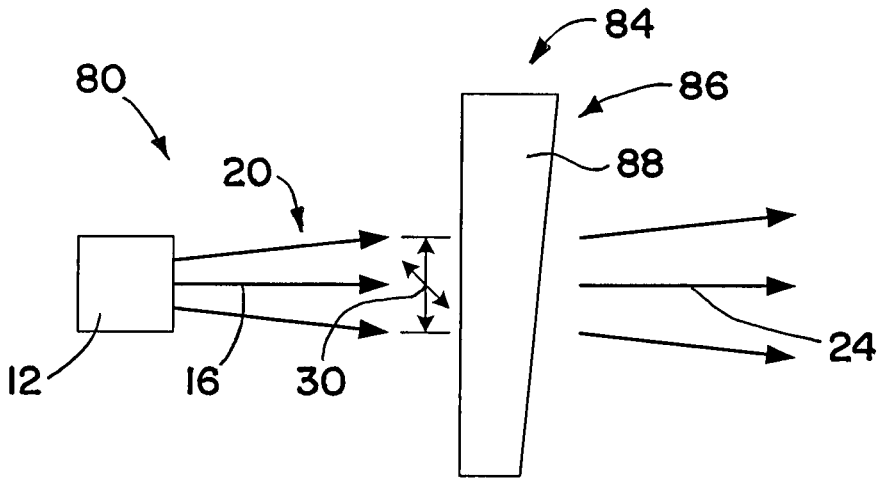
FIG. 4A is a schematic side view of a fourth light source.

FIG. 4A shows an example of a light source 80 that includes the light emitting device 12 and a spectrum adjuster 84. The spectrum adjuster 84 and the light path 20 of the light 16 emitted by light emitting device 12 are variably positionable relative to one another. The spectrum adjuster 84 includes a color-attenuating region 86 that has color-attenuating material 88 for attenuating a portion of the spectrum of the light 16 to adjust the spectrum of the output light 24. The color-attenuating material 88 has a continuously-varying color-attenuating property based on position in the color-attenuating region 86. The color-attenuating region 86 has dimensions greater than the cross-sectional dimensions 30 of the light path 20 at the spectrum adjuster 84.

In one example, the variation in color attenuation with position within the color-attenuating regions is a variation in the attenuation of light of a given color. In another example, the variation in color attenuation with position is a variation in the color of light that is attenuated. In one such case, the color-attenuating material functions as a high-pass filter, with the cutoff wavelength of the filter changing with position within the color-attenuating region 86. In another case, the color-attenuating material functions as a low-pass filter, with the cutoff wavelength of the filter changing with position within the color-attenuating region 86. In still another case, the color-attenuating material functions as a band-pass filter, with either or both of the short cutoff wavelength and the long cutoff wavelength of the filter changing with position within the color-attenuating region 86. In one example, the cut-off wavelengths change so that the bandwidth of the band-pass filter changes with position within the color-attenuating region 86. In another example, the cut-off wavelengths change so that the center wavelength of the passband of the band-pass filter changes with position within the color-attenuating region 86. In a third example, the cut-off wavelengths change so that both the wavelength range and the center wavelength change with position within the color-attenuating region 86. Various combinations of these characteristics are possible in the color-attenuating material.

Any of a variety of color-attenuating materials may be used as color-attenuating material 88 within color-attenuating region 86. Suitable color-attenuating materials include organic or inorganic color-attenuating materials that can be added to glass or polymer materials in varying amounts to provide desired color-attenuating properties, both in terms of the color(s) attenuated, and the amount of attenuation. The color attenuation (an example of the variation color-attenuating property) may be varied by varying the concentration of the color-attenuating material 88 at different positions within the color-attenuating region 86. Alternatively, the color attenuation may be varied by varying the thickness of the color-attenuating material 88 at different positions within the color-attenuating region 86. For instance, the color-attenuating region 86 may include a variable-thickness layer that includes the color-attenuating material 88. The variable-thickness layer is supported by a substrate or other layer of optically-transparent or optically-transmissive material.

Figure 4B:
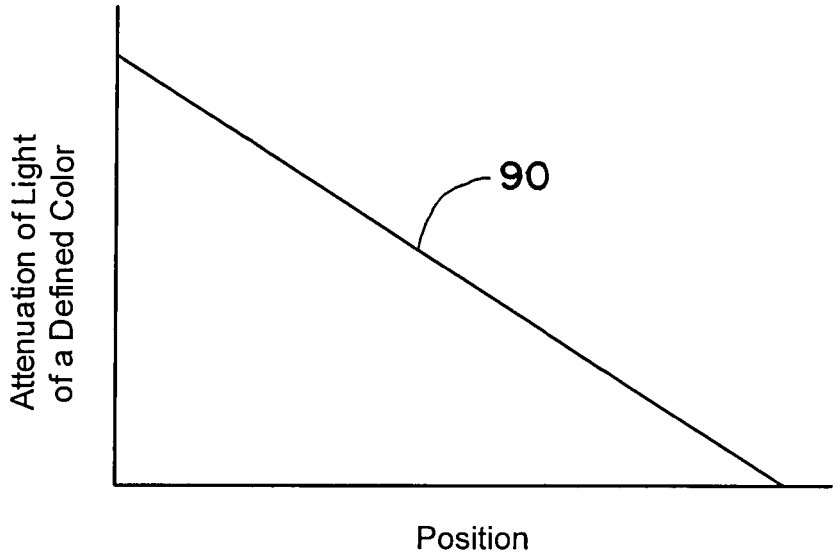
FIG. 4B is a graph showing an example of variation of attenuation of light of a defined color, with position.
Figure 4C:
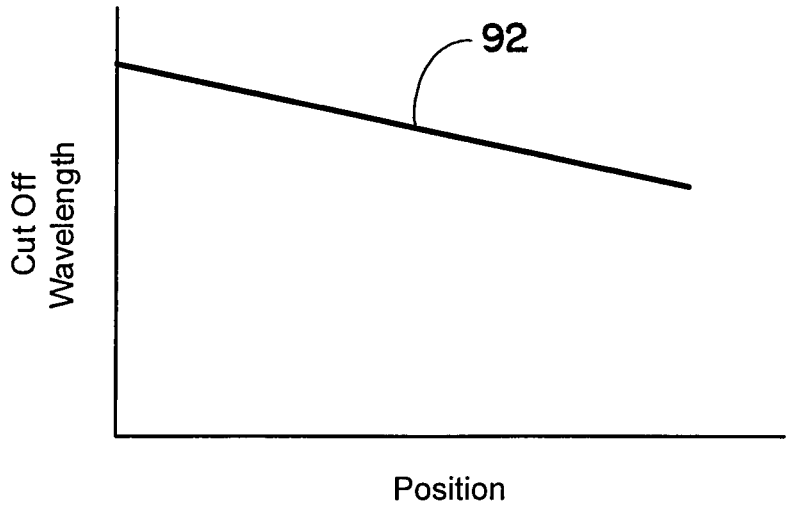
FIG. 4C is a graph showing an example of variation of cutoff wavelength with position.

FIGS. 4B and 4C show examples of the variation of the color-attenuating property of the color-attenuating material 88 with position in the color-attenuating region 86. In FIG. 4B, the color-attenuating property is the attenuation of light of a defined color by the color-attenuating material 88. In FIG. 4C, the color-attenuating property is the cutoff wavelength 92 (either a short cutoff wavelength or a long cutoff wavelength) of the color-attenuating material 88. In the examples shown, the color-attenuating property varies linearly with position in the color-attenuating region 86. In other examples, the color-attenuating property varies non-linearly with position in the color attenuating region 86.

In the example shown in FIG. 4A, the color-attenuating material 88 is shown as being self-supporting. In another example, the color-attenuating material 88 is supported by a suitable substrate (not shown), such as a substrate made of acrylic, silicone, glass, polyethylene terephthalate, polymethyl methacrylate, and/or polycarbonate.

In one embodiment, the change in color-attenuating property is combined with additional features to keep the overall intensity of the output light 24 the same for different relative positioning of the spectrum adjuster 84 and the light path 20. In one example, a neutral-density filter is used as a substrate for the color-attenuating material 88. The neutral-density filter has a variation of attenuation with position that compensates for any positional variations in intensity of light passing through the color-attenuating material 88. In another example, the current supplied to the light emitting device 12 is adjusted as the position of the spectrum adjuster 84 relative to the light path 20 changes, to maintain the same intensity in the output light 24.

Figure 5:
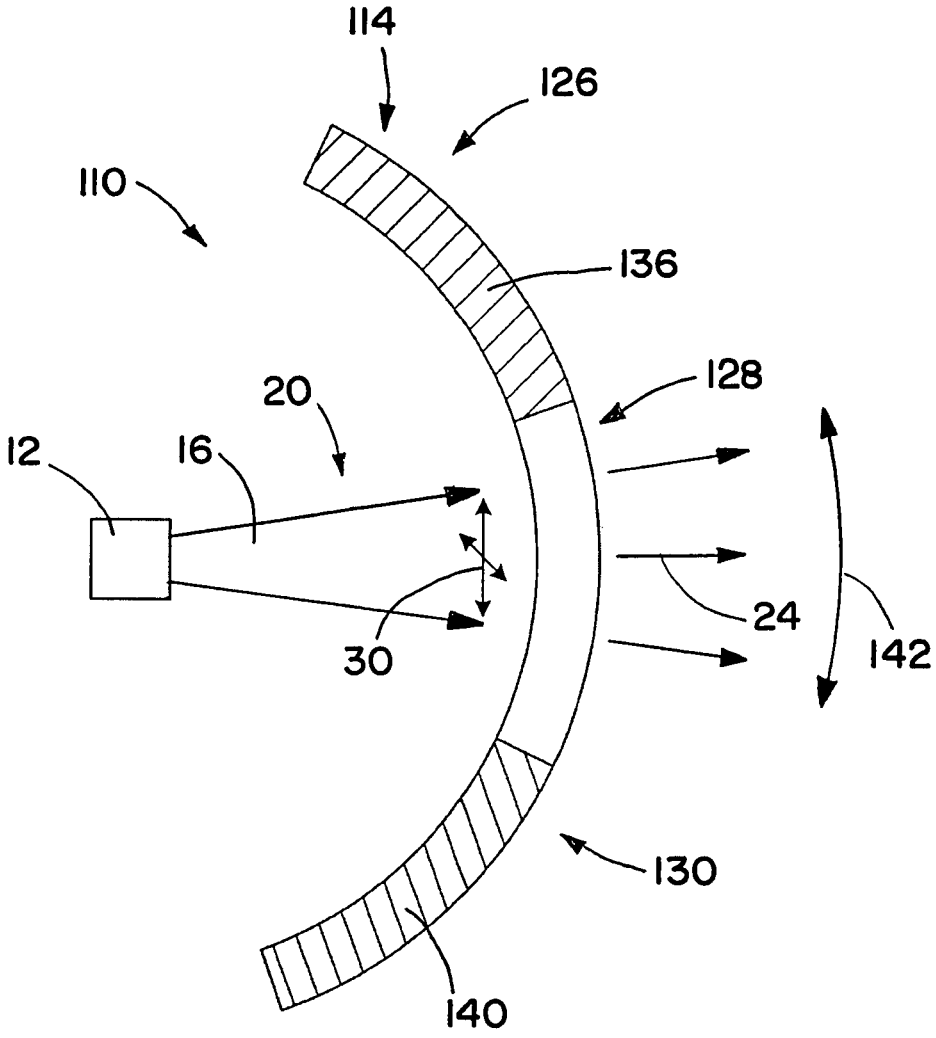
FIG. 5 is a schematic side view of a fifth light source.
Figure 6:
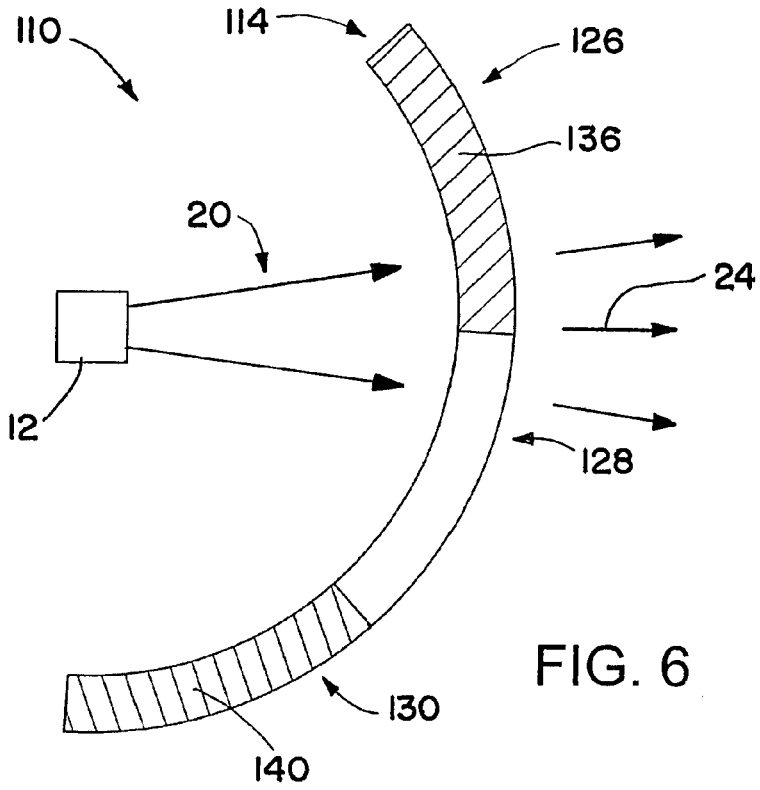
FIG. 6 is a schematic side view of the light source of FIG. 5, with the spectrum adjuster in a different position relative to the light path of the light from the light emitter.
Figure 7:
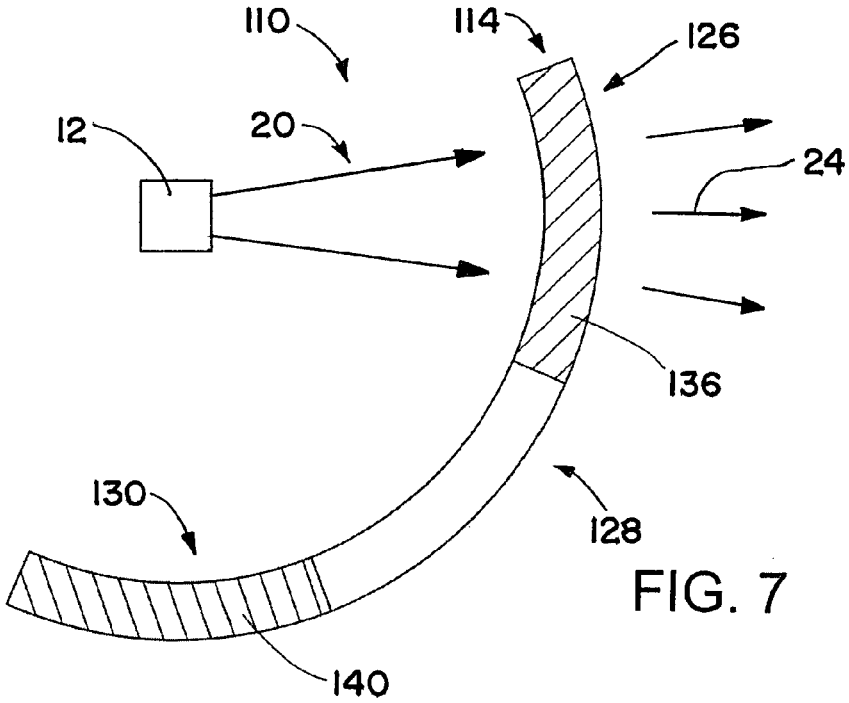
FIG. 7 is a schematic side view of the light source of FIG. 5, with the spectrum adjuster in another different position relative to the light path.

FIGS. 5-7 show an example of a light source 110 having a spectrum adjuster 114. Color-attenuating regions 126 and 130 of spectrum adjuster 114 have respective color-attenuating materials 136 and 140. Between the color-attenuating regions 126 and 130 is a non-color-attenuating region 128 that contains no operably-effective amount of color-attenuating material. In an example, the color-attenuating materials 136 and 140 attenuate light of different colors. The color-attenuating materials 136 and 140 each have a respective continuously-variable color-attenuating property based on position within the color-attenuating regions 126 and 130. In an example, the color-attenuating property continuously varies from a minimum of color-attenuating property at the respective proximal ends of the color-attenuation regions 126, 130, where the color-attenuating regions 126 and 130 border the non-color-attenuating region 128, to a maximum of color-attenuating property at their respective distal ends farthest away from the non-color-attenuating region 128. In an example, the minimum value of the color-attenuating property is zero (no operably-effective amount of color-attenuation). In another example, the minimum value is greater than zero. The color-attenuating property may increase monotonically with position within the individual color-attenuating regions 126 and 130, i.e., the color-attenuating property always increases or decreases as the position changes in a given direction. The monotonic variation may be linear or nonlinear.

Any of a variety of color-attenuating materials may be used to provide the color-attenuating property within the spectrum adjusting regions. Examples of color-attenuating materials are described above with reference to the color-attenuating material 88 (FIG. 4A). The color-attenuating materials 136 and 140 may be configured to attenuate different respective portions of the spectrum of the light 16 output by light emitting device 12. In an example, the color-attenuating material 136 is a red filter material for attenuating red light, and the color-attenuating material 140 is a blue filter material for attenuating blue light.

Varying the relative positioning of the spectrum adjuster 114 and the light path 20 of the light 16 emitted by light emitting device 12 changes the position at which light 16 is incident on spectrum adjuster 114, and hence adjusts the spectrum of the output light 24 from the light source 110.

In the example of relative positioning shown in FIG. 5, all of the light 16 emitted by the light emitting device 12 is incident on the non-color-attenuating region 128. References herein to "all" of the light being incident at a stated position do not preclude the possibility that negligible portions of the light are incident elsewhere. The relative positioning shown in FIG. 5 is an intermediate positioning in the adjustment range 142 of the relative positioning of the spectrum adjuster 114 and the light path 20. With the relative positioning shown in FIG. 5, the light 16 is incident on the non-color-attenuating region 128, and the output light 24 nominally has the same spectrum as the light 16. The cross-sectional dimensions 30 of the light path 20 at the spectrum adjuster 114 are less than the dimensions of the non-color-attenuating region 128.

FIG. 6 shows an example in which the relative positioning between the spectrum adjuster 114 and the light path 20 of the light 16 emitted by the light emitting device 12 has been varied such that the light 16 is incident on both the color-attenuating region 126 and the non-color-attenuating region 128. In this example, the positioning has been varied by moving the spectrum adjuster 114 relative to the light path 20. The relative positioning shown results in some color attenuation since a portion of light 16 passes through color-attenuating region 126.

FIG. 7 shows an example in which the relative positioning between the spectrum adjuster 114 and the light path 20 has been further varied such that all of the light 16 is incident on the color-attenuating region 126. The relative positioning shown provides more color attenuation in the output light 24 than was obtained in the example of relative positioning shown in FIG. 6.

Figure 8:
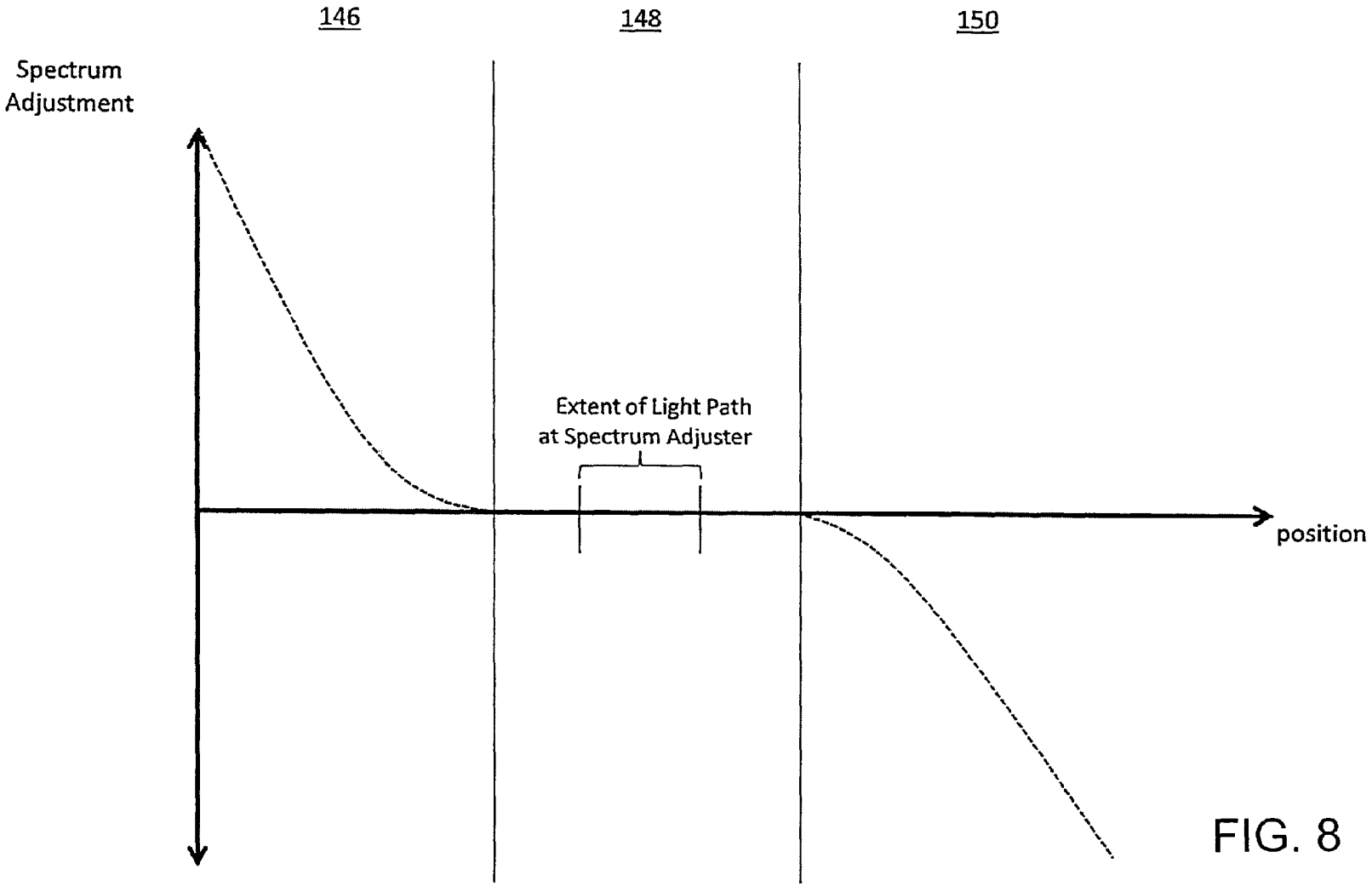
FIG. 8 is a graph of spectrum change versus relative positioning for the light source of FIG. 5.

FIG. 8 shows a graph of spectrum adjustment as a function of relative positioning between spectrum adjuster 114 and the light path 20. A region 148 of the graph corresponds to the relative positioning example shown in FIG. 5 in which all of the light 16 is incident on a non-spectrum-adjusting region corresponding to the non-color-attenuating region 128. In the non-spectrum-adjusting region no operably-effective adjustment of the spectrum of light 16 occurs.

A region 146 of the graph corresponds to the relative positioning example shown in FIG. 7, in which all the light 16 is incident on a spectrum-adjusting region corresponding to the color-attenuating region 126. The spectrum-adjusting region provides a first positioning-dependent change in the spectrum of the output light 24. In an example, the first positioning-dependent change in the spectrum is a positioning-dependent attenuation of light of a first color. The positioning-dependent change in spectrum increases with increasing distance along the horizontal axis from region 148.

A region 150 corresponds to a relative positioning in which all of light 16 is incident on a spectrum-adjusting region corresponding to the color-attenuating region 130. This spectrum-adjusting region provides a second position-dependent change in the spectrum of the output light 24. In an example, the second positioning-dependent change in the spectrum is a positioning-dependent attenuation of light of a second color. The position-dependent change in spectrum increases with increasing distance along the horizontal axis from region 148.

In the examples shown in FIGS. 5-7, the spectrum adjuster 114 is shown as having opposed curved surfaces facing towards and away from the light emitting device 12, and is positionable by rotation about an axis (not shown).

Figure 9:
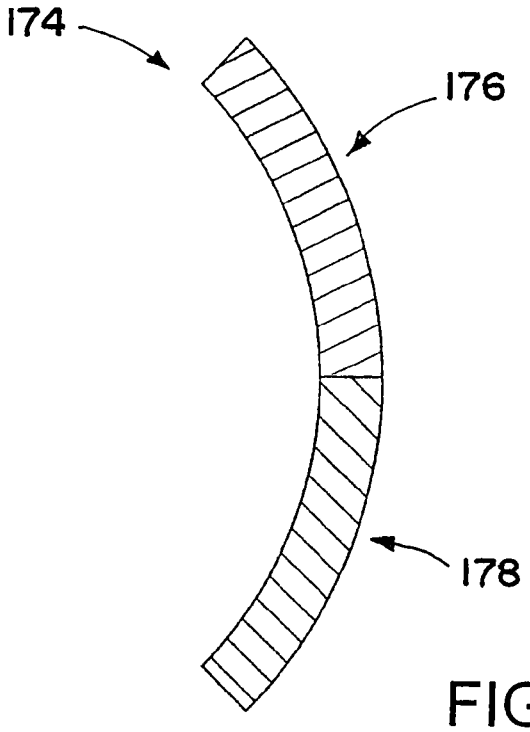
FIG. 9 is a side view of a spectrum adjuster.

FIG. 9 illustrates a spectrum adjuster 174 that is similar to the spectrum adjuster 114 (FIG. 5), but with the non-color-attenuating region 128 (FIG. 5) omitted. The spectrum adjuster 174 has a first color-attenuating region 176 that is adjacent to a second color-attenuating region 178.

Figure 10:
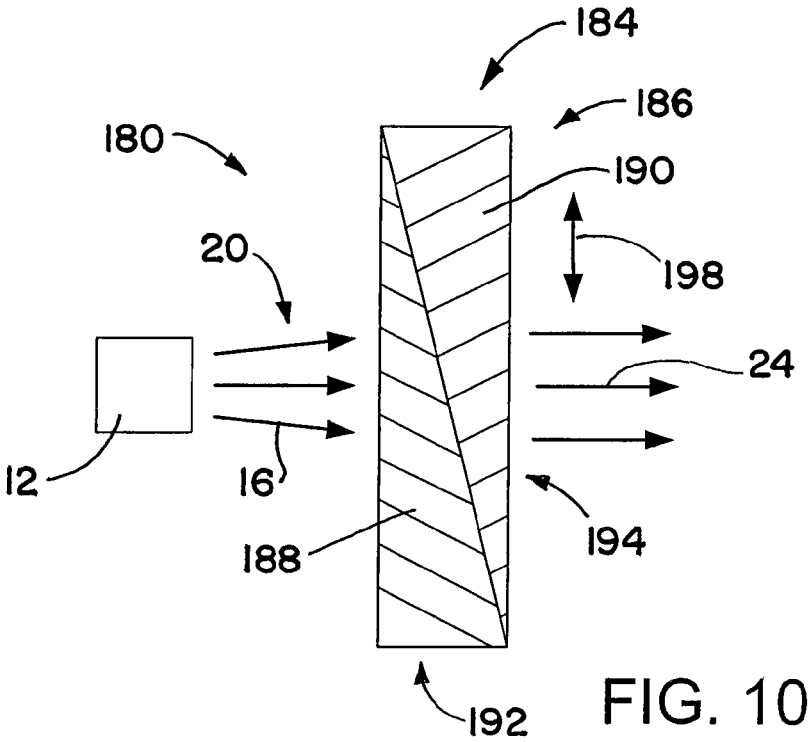
FIG. 10 is a schematic side view of a sixth light source.

FIG. 10 shows a light source 180 that has a spectrum adjuster 184 that includes a color-attenuating region 186 that includes two color-attenuating materials 188 and 190. The color-attenuating materials 188 and 190 attenuate different portions of the spectrum. For example, the color-attenuating material 188 is a red filter material for attenuating red light, and the color-attenuating material 190 is a blue filter material for attenuating blue light. At least one of the color-attenuating materials 188 and 190 provides a continuously-varying color-attenuating property that depends on position within the color-attenuating region 186.

In the example shown, each of the color-attenuating materials 188 and 190 provides a respective continuously-varying color-attenuating property that depends on position within the color-attenuating region 186. The color-attenuating materials 188 and 190 are shown in respective layers 192 and 194 that overlap one another. The thicknesses of the layers 192 and 194 vary in an adjustment direction 198, i.e., the direction in which the spectrum adjuster 164 and the light path 20 of light 16 emitted by light emitting device 12 are variably positionable relative to one another. The thicknesses of the layers 192 and 194 determine the color attenuation provided by the color-attenuating materials 188 and 190 in the layers 192 and 194. At one end of the spectrum adjuster 184, the layer 192 has a minimum thickness (minimum attenuation), and the layer 194 has a maximum thickness (maximum attenuation). Between the ends of the spectrum adjuster 184, the layer 192 increases in thickness while the layer 194 decreases in thickness until, at the other end of the spectrum adjuster 184, the layer 192 has a maximum thickness, while the layer 194 has a minimum thickness.

In the example shown in FIG. 10, the variation of the thicknesses of the layers 192 and 194 with position is linear and the combined thickness of the layers 192 and 194 is constant. In other examples, the variation of the thicknesses of the layers 192 and 194 with position is non-linear. In yet other examples, the variation of the thicknesses of the layers 192 and 194 with position is non-monotonic. In addition, the combined thickness of the layers 192 and 194 may be non-constant, for example, the combined thickness may vary with position in the adjustment direction 198.

Alternatively, the color-attenuating materials 188, 190 may both be in a single layer. For example, dots of the different color-attenuating materials may be separately applied to a substrate, such as a glass substrate. The dots may change in size (area and/or thickness) with position. The dots may be applied by such processes as inkjet printing and screen printing. Whether the color-attenuating materials are in a single layer or in multiple layers, more than two color-attenuating materials may be used. A color-attenuating region with multiple color-attenuating materials may be utilized in others of the light sources described herein.

Figure 11:
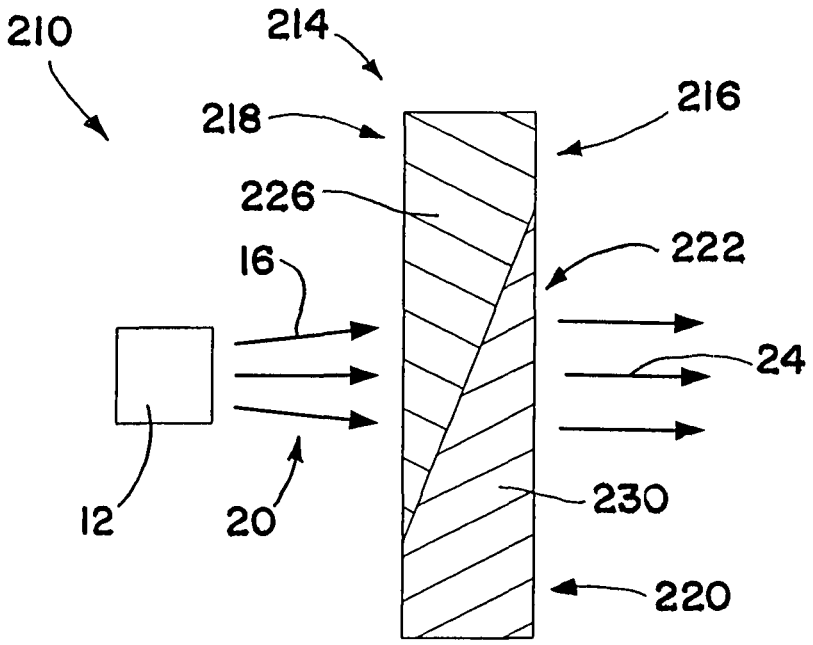
FIG. 11 is a schematic side view of a seventh light source.

With reference now to FIG. 11, a light source 210 has a spectrum adjuster 214. The spectrum adjuster 214 has layers 226 and 230 of respective color-attenuating materials. Each of the layers 226, 230 has a non-overlapped region 218, 220 and an overlapped region 222 between the non-overlapped regions, in which the layers 226, 230 overlap one another. This structure of spectrum adjuster 214 allows relative positionings between the spectrum adjuster 214 and the light path 20 in which only one of the layers 226, 230 of color-attenuating material attenuates a respective portion of the spectrum of light 16.

Figure 12:
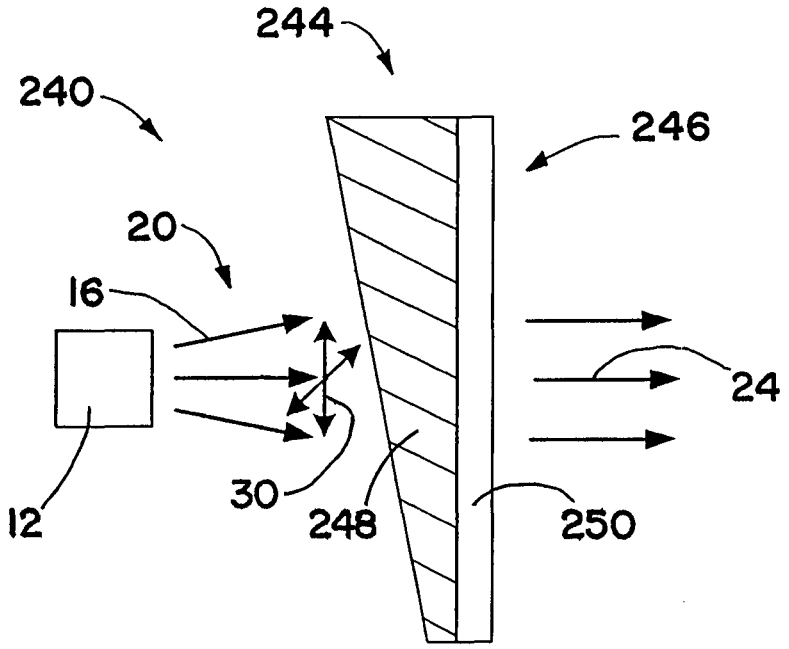
FIG. 12 is a schematic side view of an eighth light source.

FIG. 12 shows a light source 240 that includes a spectrum adjuster 244. Spectrum adjuster 244 and the light path 20 of light 16 emitted by light emitting device 12 are variably positionable relative to one another. The spectrum adjuster 244 includes a wavelength-shifting region 246 that includes wavelength-shifting material 248. A "wavelength-shifting material" is a material that absorbs light of certain wavelengths, and reemits light at one or more different wavelengths. Examples of a wavelength-shifting material include a phosphor material, a luminescent material, a luminescent nanomaterial such as a quantum dot material, a conjugated polymer material, an organic fluorescent dye, and an organic phosphorescent dye. The wavelength-shifting region 246 has dimensions greater than the cross-sectional dimensions 30 of the light path 20 at the spectrum adjuster 244.

The wavelength-shifting material 248 has a continuously varying wavelength-shifting property based on position in the wavelength-shifting region 246. The positioning of the spectrum adjuster 244 relative to the light path 20 of the light 16 emitted by light emitting device 12 determines the portion of the light 16 subject to wavelength shifting, dependent upon the thickness and/or concentration of wavelength-shifting material 248. Absorption of the portion of the incident light 16 and reemission at one or more different wavelengths changes the spectrum of the output light 24 output by the light source 240. In the example shown, the wavelength-shifting material 248 is located on a substrate 250. Examples of suitable materials for the substrate include acrylic, silicone, glass, polyethylene terephthalate, polymethyl methacrylate, and polycarbonate.

Figure 13:
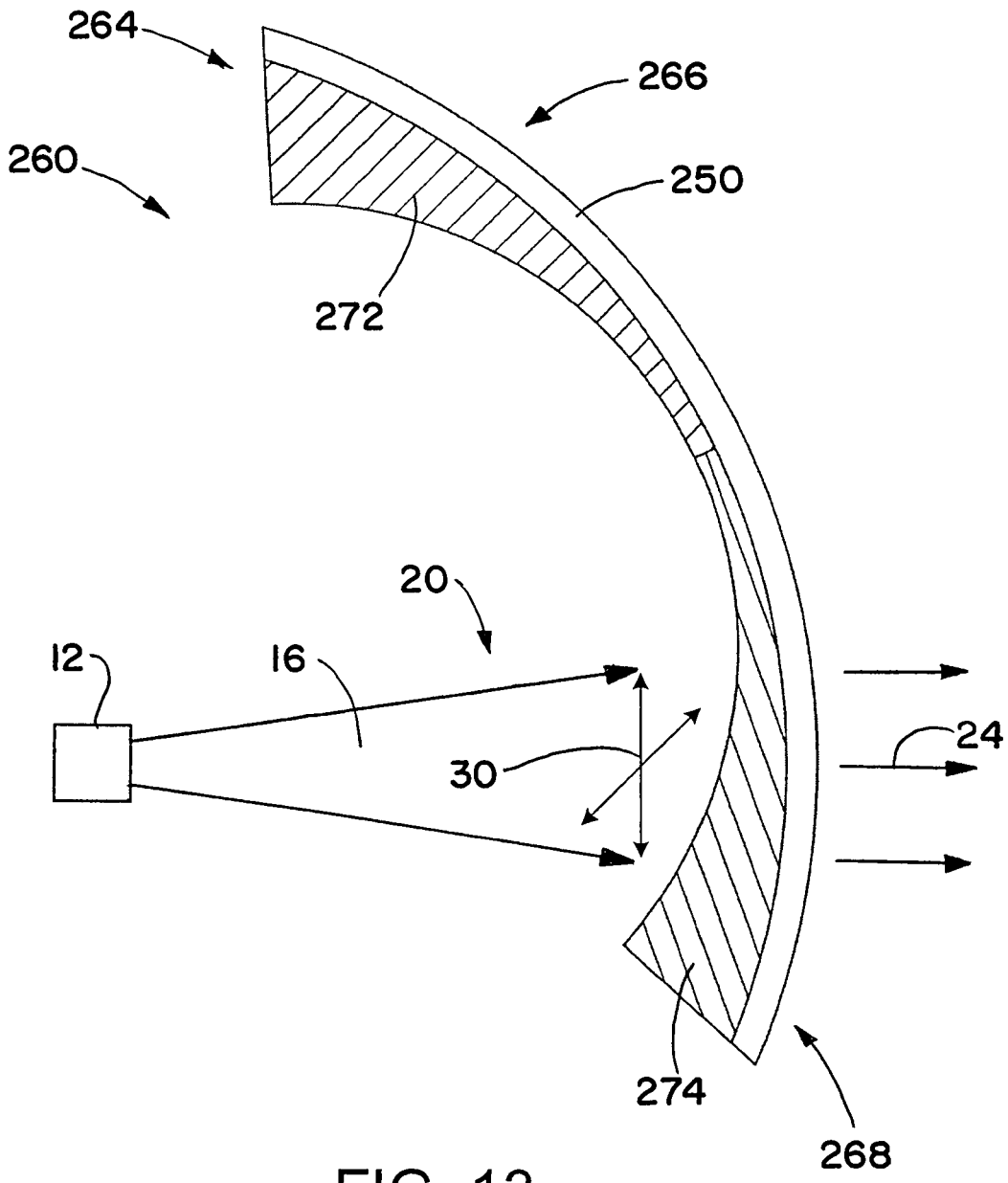
FIG. 13 is a schematic side view of a ninth light source.
Figure 14:
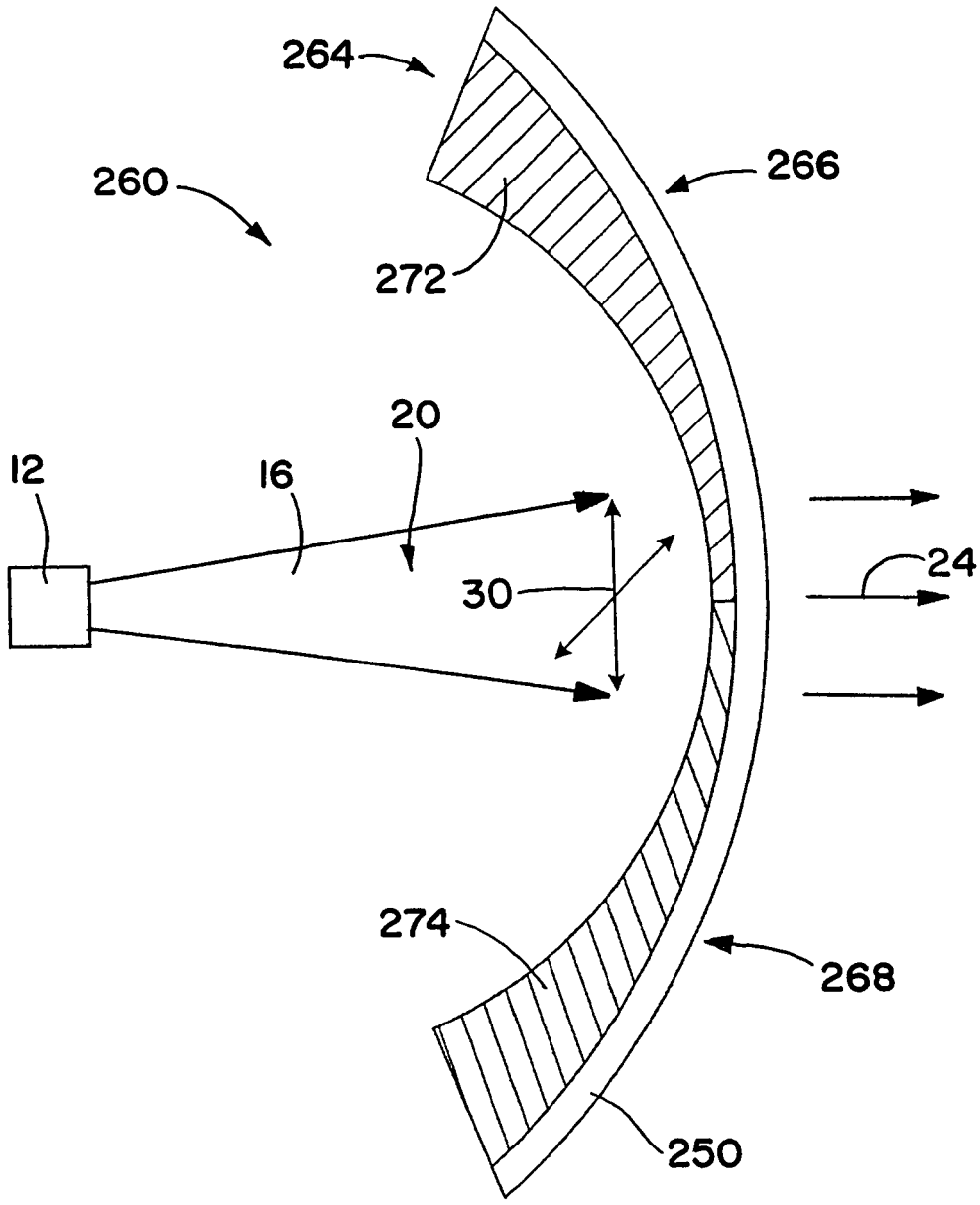
FIG. 14 is a schematic side view of the light source of FIG. 13, with the spectrum adjuster in a different position relative to the light path of the light from the light emitting device.

FIGS. 13 and 14 show a light source 260 that includes a spectrum adjuster 264 that shifts the wavelength of at least a portion of the light 16 emitted by a light emitting device 12. The spectrum adjuster 264 includes wavelength-shifting regions 266 and 268 that shift the wavelength of such portion of the light 16. The wavelength-shifting regions 266 and 268 include respective wavelength-shifting materials 272 and 274 that are on a substrate 250. The wavelength-shifting regions 266, 268 shift the wavelength of at least a portion of the light 16 to produce output light 24 with a spectrum different from that of the light 16. The wavelength-shifting materials 272 and 274 have continuously varying wavelength-shifting properties based on position in the wavelength-shifting regions 266 and 268. The wavelength-shifting regions 266 and 268 each have dimensions greater than a cross-sectional dimensions 30 of the light path 20 at the spectrum adjuster 264.

In an example, the wavelength-shifting materials 272 and 274 are materials for producing respective changes in the spectrum of the light 16. When illuminated with ultra-violet light, the wavelength-shifting material 272 produces one color of output light, such as blue, while the wavelength-shifting material 274 produces another color of output light, such as green.

FIG. 13 shows an example in which the relative positioning of the spectrum adjuster 264 and the light path 20 of the light 16 emitted by the light emitting device 12 is such that all the light 16 is incident on the wavelength-shifting region 268. FIG. 14 shows an example in which the relative positioning has been changed such that the light 16 is incident similarly on portions of both of the wavelength-shifting regions 266 and 268. Varying the relative positioning of the spectrum adjuster 264 and the light path 20 provides different spectra of the output light 24. The wavelength-shifting materials 272, 274, by absorption and reemission, change the spectrum of a portion of the light 16 emitted by the light emitting device 12.

In an example, the light emitting device 12 is a blue light emitting device, the wavelength-shifting material 272 absorbs part of the blue light and emits red light in an amount depending on the thickness of the wavelength-shifting material 272 where light 16 is incident on the wavelength-shifting region 266. Moreover, the wavelength-shifting material 274 absorbs part of the blue light and emits green light in an amount depending on the thickness of the wavelength-shifting material 274 where the light 16 is incident on the wavelength-shifting region 268. Varying the relative positioning of the spectrum adjuster 264 and light path 20 causes the spectral adjuster to adjust the color of the "white" output light 24 from reddish to greenish.

Figure 15:
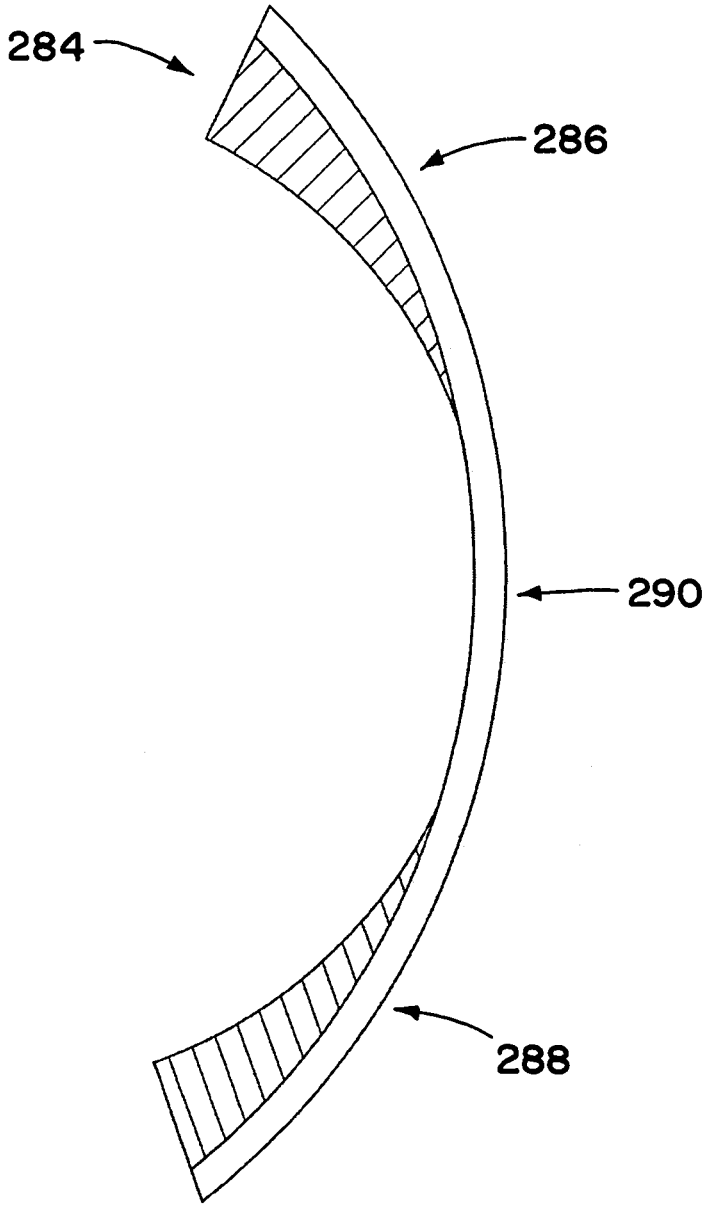
FIG. 15 is a side view of another spectrum adjuster.

FIG. 15 shows a spectrum adjuster 284 that includes wavelength-shifting regions 286 and 288, and a non-wavelength-shifting region 290 between the wavelength-shifting regions 286 and 288. In other regards the spectrum adjuster 284 is similar to the spectrum adjuster 264.

Figure 16:
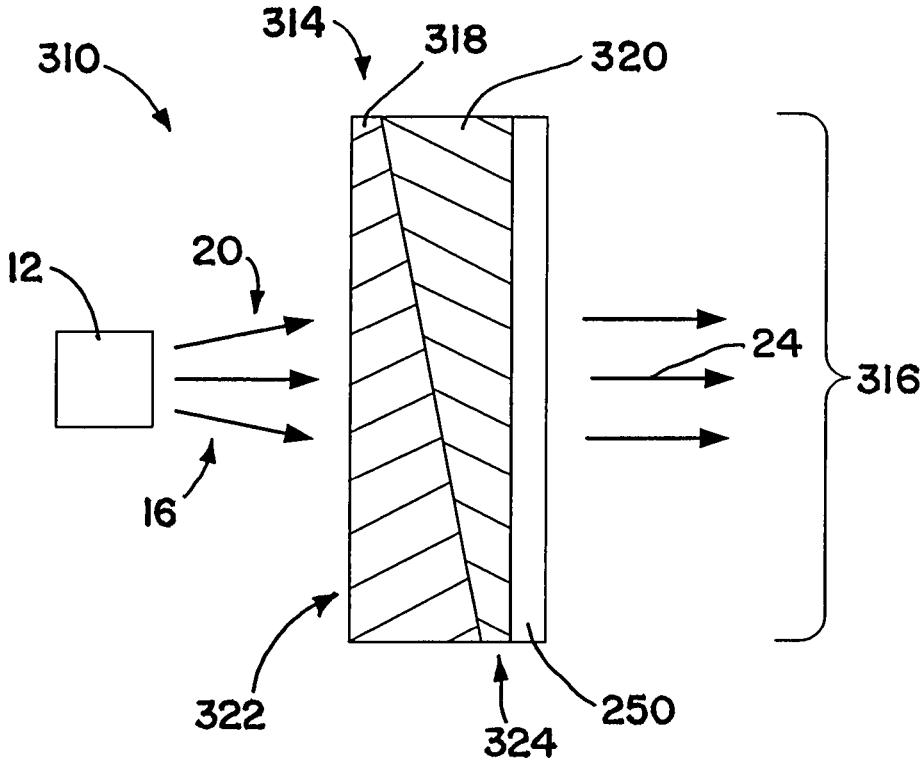
FIG. 16 is a schematic side view of a tenth light source.

FIG. 16 shows a light source 310 that has a spectrum adjuster 314 that has a wavelength-shifting region 316 that contains two wavelength-shifting materials 318 and 320 having different wavelength-shifting properties. The wavelength-shifting materials 318 and 320 are in different respective layers 322 and 324, mounted on a substrate 250. A ratio, as will be described below, between the wavelength-shifting materials 318 and 320 continuously varies with position in the wavelength-shifting region 316.

Figure 17:
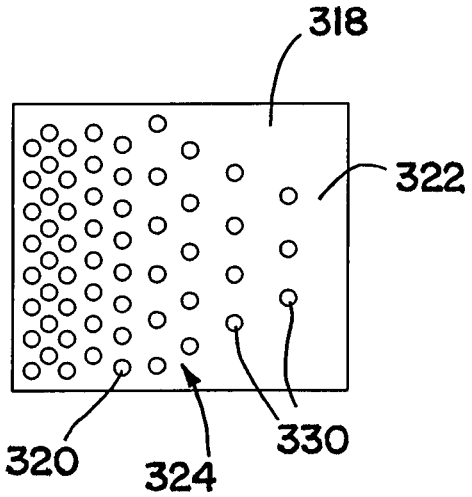
FIG. 17 is a plan view of one possible configuration of the wavelength-shifting materials of the light source of FIG. 16.
Figure 18:
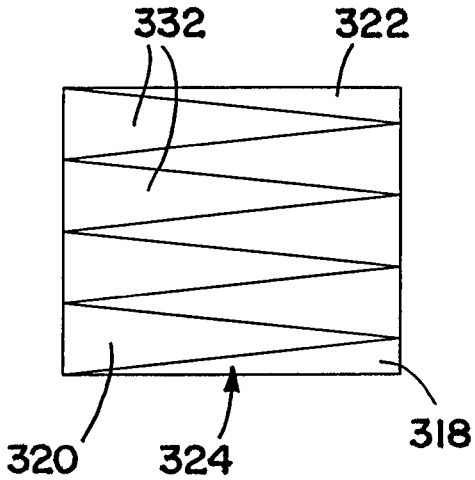
FIG. 18 is a plan view of another possible configuration of the wavelength-shifting materials of the light source of FIG. 16.

In some examples, the ratio between the wavelength-shifting materials 318 and 320 is the ratio of the thicknesses of the layers 322 and 324, as shown in FIG. 16. In other examples, with reference to FIGS. 17 and 18, the ratio is the ratio of the respective concentrations of wavelength-shifting material in the layers 322 and 324. The concentration of wavelength-shifting material in one or both of the layers may be varied by suitable patterning. As shown in FIGS. 17 and 18, the layer 322 is a continuous layer of one wavelength-shifting material 318 and the layer 324 is a discontinuous layer of another wavelength-shifting material 320. Alternatively, both of the layers 322 and 324 may be discontinuous, with different patterns.

The discontinuous layer 324 may be patterned with any of a variety of suitable patterns. FIG. 17 shows a pattern of dots 330 of the wavelength-shifting material 320, with the dots changing in density with position. Additionally or alternatively, the dots may change in size (area and/or thickness) with position. The dots may be applied by such processes as ink-jet printing and screen printing. FIG. 18 shows a pattern of triangular elements 332 of the wavelength-shifting material 320 that provides a variation with position of the ratio between the wavelength-shifting materials 318 and 320. A wide variety of other suitable patterns is possible. In addition, patterning may be combined with variations in thickness, concentration or other types of variation in the wavelength-shifting materials 318 and 320.

The wavelength-shifting materials may both be in a single layer. For example, dots of the different wavelength-shifting materials 318, 320 may be separately applied to a substrate in a manner similar to that described above with reference to FIG. 17, with the dots changing in density with position, and/or changing in size (area and/or thickness) with position.

The positions of the dots may be randomized. Shapes other than dots may be used. Whether the wavelength-shifting materials 318 and 320 are in a single layer or in multiple layers, more than two wavelength-shifting materials may be used. A wavelength-shifting region with multiple wavelength-shifting materials may be utilized in others of the light sources described herein.

Figure 19:
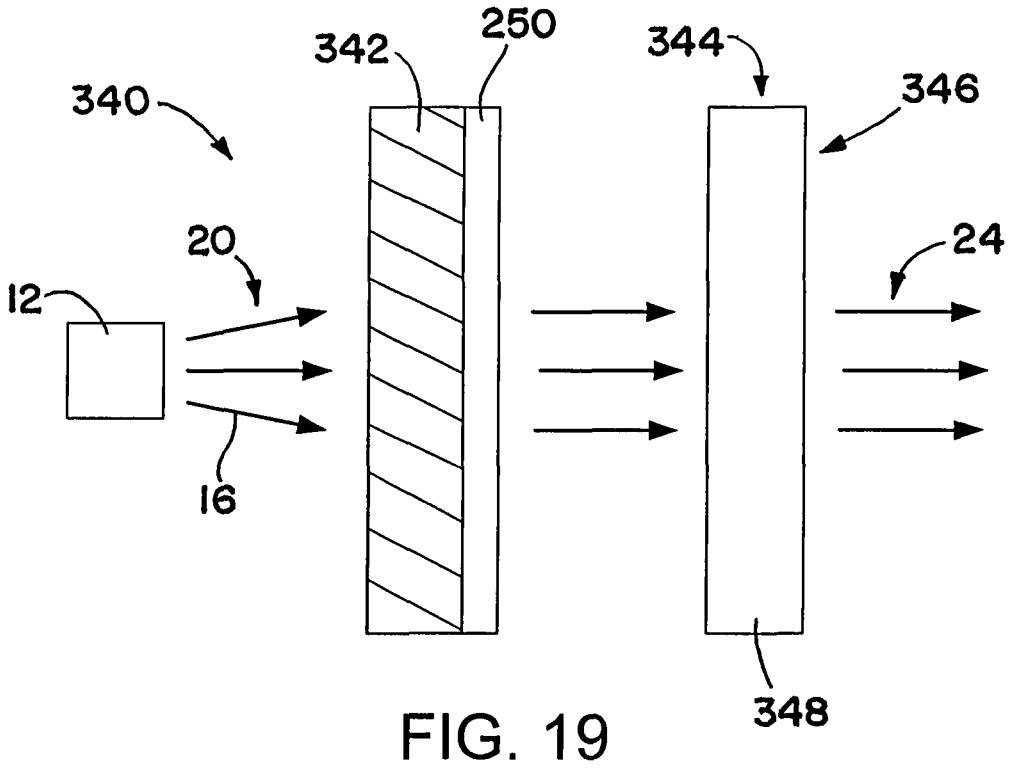
FIG. 19 is a schematic side view of an eleventh light source.

FIG. 19 illustrates a light source 340 that has a wavelength-shifting material 342 on a substrate 250. The wavelength-shifting material 342 and the substrate 250 are located between a light emitting device 12 and a spectrum adjuster 344, in the light path 20 of light 16 emitted by the light emitting device. In another example, the wavelength-shifting material 342 is on the spectrum adjuster 344, which may be on a substrate. The spectrum adjuster 344 includes a color-attenuating region 346 that has color-attenuating material 348 on which light output by the wavelength-shifting material 342 is incident. The color-attenuating material 348 has a continuously varying color-attenuating property based on position in the color-attenuating region 346, as described above with regard to other light sources. The spectrum adjuster 344 and the light path 20 of the light 16 emitted by the light source 12 are variably positionable relative to one another.

The wavelength-shifting material 342 shifts, by absorption and reemission, the spectrum of a portion of the light 16 emitted by the light emitting device 12. In an example, the light emitting device 12 is a blue light emitting device, and the wavelength-shifting material 342 absorbs part of the blue light and emits yellow light. The color-attenuating region 346 then further changes the spectrum of the light output by the wavelength-shifting material 342 depending on its positioning relative to the light path 20 of the light 16 output by light emitting device 12.

In some embodiments, the wavelength-shifting material 342 has a substantially uniform wavelength-shifting property over its entire area. In other embodiments, there is a positional variation in the wavelength-shifting property of the wavelength-shifting material 342. In some embodiments, the wavelength-shifting material 342 is attached to the color-attenuating region 346, while in other embodiments, the wavelength-shifting material 342 is separate from the color-attenuating region 346. The wavelength-shifting material 342 may be fixed in position, or may be variably positionable relative to the light path 20, either along with or separately from the spectrum adjuster 344. Wavelength-shifting material, as shown in FIG. 19 and as described above, may be added to any of the light sources described herein that utilize color-attenuating material(s). A uniform color-attenuating material could be substituted for wavelength-shifting material 342.

Figure 20:
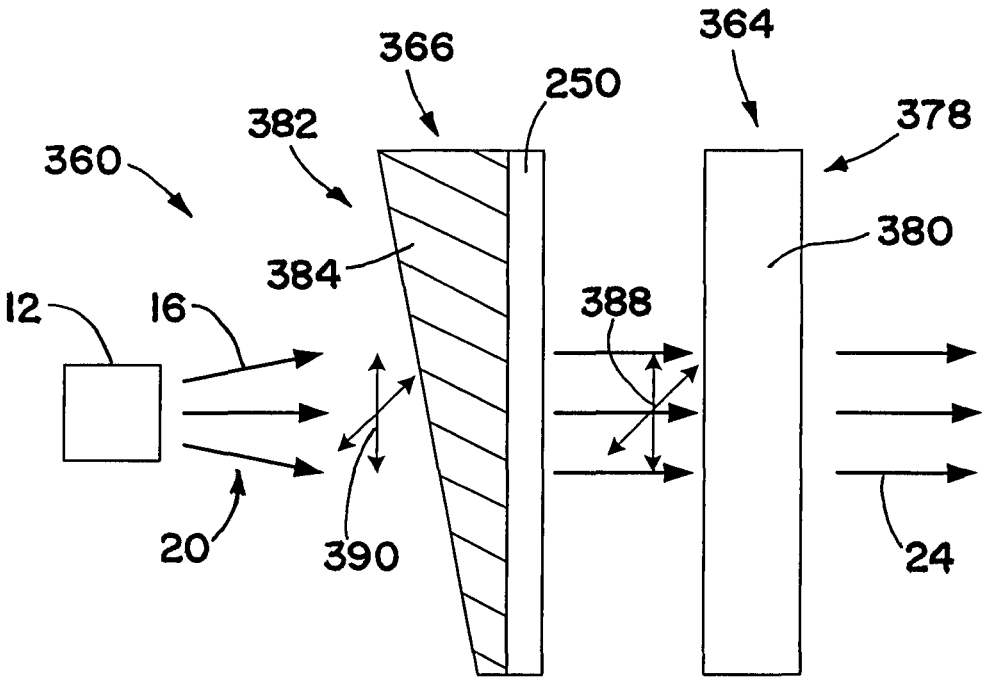
FIG. 20 is a schematic side view of a twelfth light source.

FIG. 20 shows a light source 360 that includes a light emitting device 12, and spectrum adjusters 364 and 366 that are positionable relative to the light path 20 of the light 16 emitted by light emitting device 12. The first spectrum adjuster 364 includes a first spectrum-adjusting region 378 of color-attenuating material 380. The color-attenuating material 380 has a continuously varying color-attenuating property based on position in the first spectrum-adjusting region 378. The second spectrum adjuster 366 includes a second spectrum-adjusting region 382 of wavelength-shifting material 384 on a substrate 250. The wavelength-shifting material 384 has a continuously varying wavelength-shifting property based on position in the second spectrum-adjusting region 382.

The spectrum adjusters 364 and 366 may be used to provide variable adjustment of the spectrum of light output 24 from the light source 360. The spectrum-adjusting regions 378 and 380 have dimensions that are greater than cross-sectional dimensions 388 and 390 where the light path 20 is incident on the respective spectrum adjusters 364 and 366. The continuously varying properties of the spectrum-adjusting regions 378 and 382 may be similar to those of corresponding regions described above with regard to other light sources.

As shown in FIG. 20, the light 16 is incident on the first spectrum adjuster 364 only after it has passed through the second spectrum adjuster 366. However the order of the spectrum adjusters 364 and 366 may be reversed.

The spectrum adjusters 364 and 366 may be independently variably positionable relative to the light path 20. As an alternative, the spectrum adjusters 364 and 366 may be moved together, acting as a single variably-positionable spectrum adjuster.

Figure 21:
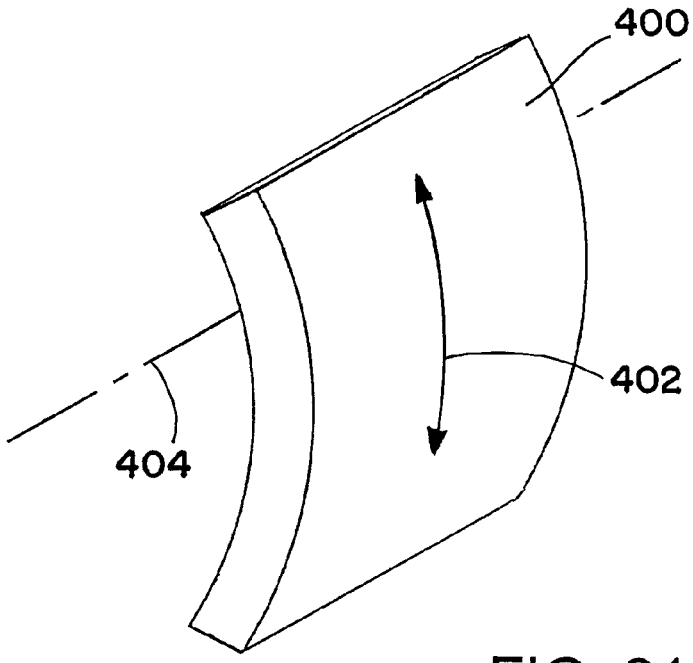
FIG. 21 is an oblique view showing one possible shape for a spectrum adjuster.
Figure 22:
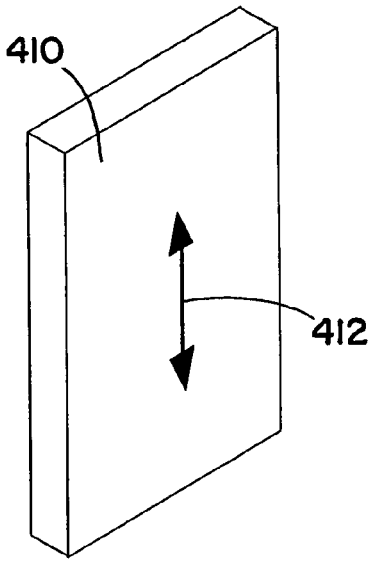
FIG. 22 is an oblique view showing another possible shape for a spectrum adjuster.
Figure 23:
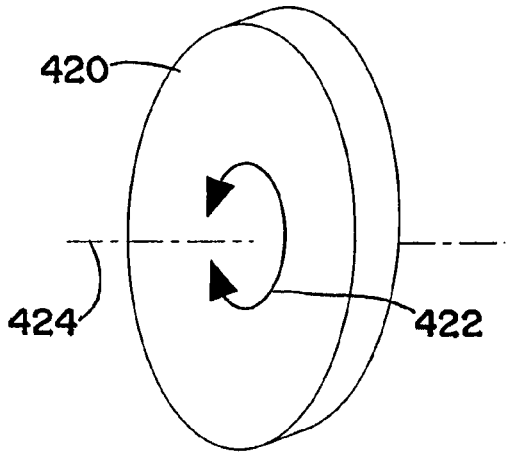
FIG. 23 is an oblique view showing yet another possible shape for a spectrum adjuster.

FIGS. 21-23 show three examples of the shapes of spectrum adjusters usable in conjunction with the light sources described above. FIG. 21 shows a curved-surface spectrum adjuster 400 that is variably positionable by moving it in a direction 402 by rotation about an axis 404 typically orthogonal to the light path. The surface of the spectrum adjuster 400 is curved about a single axis which is parallel to, and typically coincident with, axis 404. The shape that has just been described is referred to herein as a "curved shape." FIG. 22 shows a flat spectrum adjuster 410 that is variably positionable by translation in a direction of translation 412 typically orthogonal to the light path. FIG. 23 shows a disk-shaped spectrum adjuster 420 that is variably positionable by rotation in a direction 422 about an axis 424 through the center of the disk. The axis 424 is typically parallel to light path. Other spectrum adjuster configurations are possible.

References herein to a "light bulb" are meant to broadly encompass light-producing devices that fit into and engage any of various fixtures for mechanically mounting the light-producing device and for providing electrical power thereto. Examples of such fixtures include, without limitation, screw-in fixtures for engaging an Edison light bulb base, a bayonet fixture for engaging a bayonet light bulb base, or a bi-pin fixture for engaging a bi-pin light bulb base. Thus the term "light bulb," by itself, does not provide any limitation on the shape of the light-producing device, or the mechanism by which light is produced from electric power. Also, the light bulb need not have an enclosed envelope forming an environment for light generation. The light bulb may conform to American National Standards Institute (ANSI) or other standards for electric lamps, but the light bulb does not necessarily have to have this conformance.

Figure 24:
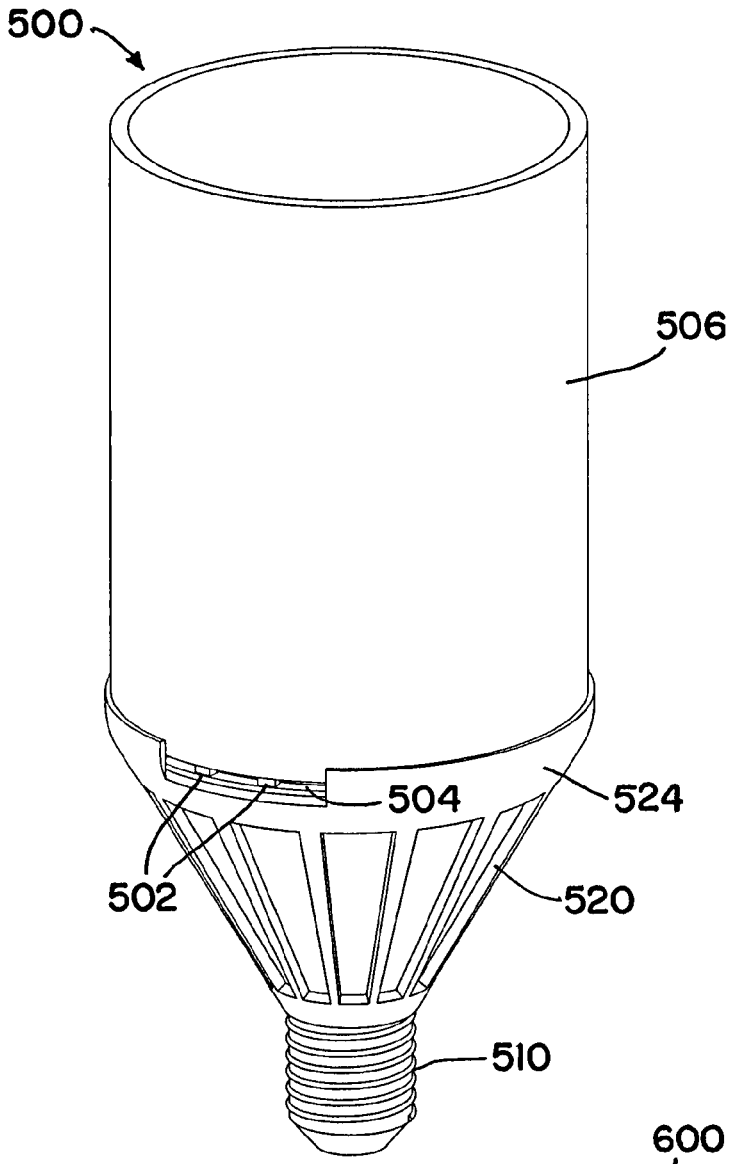
FIG. 24 is an oblique, partially cutaway, view of a light bulb.

The light bulb 500 incorporates one or more instances of any one of the light sources described above with reference to FIGS. 1-23. In the example shown, the light bulb 500 has light sources represented in FIG. 24 by the blocks labeled 502. The light sources are spaced apart along the light input edge 504 of a cylindrical light guide 506. The light sources 502 direct output light (24 in, e.g., FIG. 1) into the light guide 506. The light propagates in the light guide 506 by total internal reflection. The light emitting devices (12 in, e.g., FIG. 1) of the light sources 502 are electrically coupled to the base 510 of the light bulb 500. The base 510 is used for securing the light source 500 in a lighting fixture (not shown), and for receiving electrical power. The illustrated base 510 is an Edison base, but other types of bases 510 may be used, including any commercially-standard base or proprietary base used for mechanically securing an incandescent bulb, a fluorescent bulb, a compact fluorescent bulb (CFL), a halogen bulb, a high intensity discharge (HID) bulb, an arc lamp, or any other type of bulb into a lamp, a lighting fixture, a flashlight, a socket, etc., and/or for supplying electricity to the light bulb 500. The light sources 502 and the light guide 506 are coupled to a housing 524 that, in the example shown, includes a heat sink 520 for the light-emitting devices. The housing 524 may additionally include electrical components that convert supplied power for driving light sources 502 (not shown).

The light sources 502 are adjustable to adjust the spectrum of the output light input from the light sources 502 into the light guide 506. In one example, the light sources 502 are operably coupled together such that they are adjusted as a group, to provide a similar spectrum adjustment in every one of the light sources 502. In another example, the light sources 502 are individually adjustable. In an example, the spectra of the output light of the light sources 502 are adjusted during manufacture of the light bulb 500. In an alternative example, the spectra of the light output by some or all of the light sources 502 are adjustable after manufacture, such as by an end user.

Figure 25:
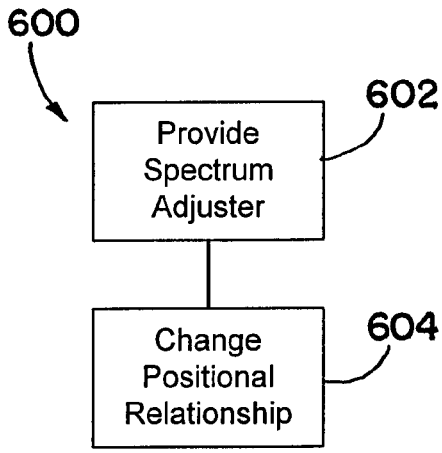
FIG. 25 is a high-level flow chart of a method of adjusting light from a light emitting device.

FIG. 25 is a high-level flowchart of a method 600 for adjusting the spectrum of the light output from a light emitting device. The method 600 is performed using a light source, such as any of the light sources described herein. At 602, a variable spectrum adjuster is provided within the light path of light emitted by the light emitting device in which the light emitting device and the spectrum adjuster are variably positionable relative to one another. The spectrum adjuster includes a spectrum-adjusting region that includes spectrum-adjusting material, with the spectrum-adjusting material having a continuously varying spectrum-adjusting property based on position in the spectrum-adjusting region. The spectrum-adjusting region has dimensions greater than the cross-sectional dimensions of the light path at the spectrum adjuster.

At 604 the positional relationship between the variable spectrum adjuster and the light path of the light emitted by the light emitting device is varied to adjust the spectrum of the light emitted by the light source. Different colors of light, including mixtures of colors, may be produced, for instance, to produce a defined technical effect, such as obtaining a specified color temperature, or to produce different moods or different visual effects.

In this disclosure, the phrase "one of" followed by a list is intended to mean the elements of the list in the alternative. For example, "one of A, B and C" means A or B or C. The phrase "at least one of" followed by a list is intended to mean one or more of the elements of the list in the alternative. For example, "at least one of A, B and C" means A or B or C or (A and B) or (A and C) or (B and C) or (A and B and C).

Other alternatives and variations are possible with regard to the above-described devices and/or methods. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the above-described devices and/or methods. In addition, while a particular feature of may have been described above with respect to only one or more of several above-described devices and/or methods, such feature may be combined with one or more other features of the other above-described devices and/or methods, as may be desired and advantageous for any given or particular situation.

What is claimed is:

1. A light bulb, comprising:

a base for mechanically mounting the light bulb and for receiving electrical power;

a light guide; and a light source that directs output light into the light guide, the light source comprising:

a light emitting device electrically coupled to the base; and a variable spectrum adjuster in a light path of light emitted by the light emitting device, wherein:

the light emitting device and the spectrum adjuster are positionable relative to one another;

the spectrum adjuster comprises a color-attenuating region comprising color-attenuating material for attenuating a portion of the spectrum of the light, the color-attenuating material having a continuously varying color-attenuating property based on position in the color-attenuating region;

the color-attenuating region has dimensions greater than the cross-sectional dimensions of the light path at the spectrum adjuster; and the spectrum adjuster additionally comprises a non-color-attenuating region, adjacent to the color-attenuating region, the non-color-attenuating region containing no operably-effective amount of a color-attenuating material.

2. The light bulb of claim 1, wherein the spectrum adjuster additionally comprises an additional color-attenuating region of an additional color-attenuating material for attenuating a different portion of the spectrum of the light, the additional color-attenuating material having a continuously varying color-attenuating property based on position in the additional color-attenuating region.

3. The light bulb of claim 1, wherein:

the spectrum adjuster additionally comprises an additional color-attenuating region of an additional color-attenuating material for attenuating a different portion of the spectrum of the light, the additional color-attenuating material having a continuously varying color-attenuating property based on position in the additional color-attenuating region; and the non-color-attenuating region is between the color-attenuating regions.

4. The light bulb of claim 1, wherein the non-color-attenuating region has dimensions greater than the cross sectional dimensions of the light path at the spectrum adjuster.

5. The light bulb of claim 1, wherein the light source additionally comprises an adjustment mechanism operatively coupled to vary the relative positioning of the light path of the light emitting device and the color-attenuating region.

6. The light bulb of claim 5, wherein the adjustment mechanism comprises a mechanism that maintains the relative positioning of the light path and the color-attenuating region.

7. The light bulb of claim 5, wherein the adjustment mechanism provides a visual indication of the adjustment of the spectrum of the light output from the light bulb.

8. The light bulb of claim 1, wherein the spectrum adjuster has a curved shape.

9. The light bulb of claim 1, wherein the light emitting device is a broad-spectrum light emitting device in the visible spectrum.

10. The light bulb of claim 1, wherein the color-attenuating region comprises overlapping color-attenuating materials, each of the color-attenuating materials having a respective continuously varying color-attenuating property for a respective color based on position in the color-attenuating region.

11. The light bulb of claim 10, wherein the light emitting device is a broad-spectrum light emitting device in the visible spectrum.

12. The light bulb of claim 1, further comprising wavelength-shifting material between the light emitting device and the spectrum adjuster.

13. The light bulb of claim 12, wherein the light emitting device is a light emitting device emitting light with no operably-effective intensity at wavelengths greater than 500 nm.

14. The light bulb of claim 1, wherein the light emitting device is a solid state light emitting device.

15. The light bulb of claim 14, wherein the solid state light emitting device is a light emitting diode.

16. The light bulb of claim 1, further comprising a heat sink that dissipates heat generated by the light source.

17. A light bulb, comprising:

a base for mechanically mounting the light bulb and for receiving electrical power;

a light guide; and a light source that directs output light into the light guide, the light source comprising:

a light emitting device electrically coupled to the base; and a variable spectrum adjuster in a light path of light emitted by the light emitting device, wherein:

the light emitting device and the spectrum adjuster are variably positionable relative to one another;

the spectrum adjuster comprises a wavelength-shifting region having a continuously varying wavelength-shifting property based on position in the wavelength-shifting region;

the wavelength-shifting region has dimensions greater than the cross-sectional dimensions of the light path at the spectrum adjuster;

the wavelength-shifting region comprises two wavelength-shifting materials with different wavelength-shifting properties, a ratio between the wavelength-shifting materials continuously varying with position in the wavelength-shifting region;

the wavelength-shifting materials are in respective layers;

one of the layers is atop the other of the layers;

the wavelength-shifting materials are differently patterned;

one of the wavelength-shifting materials is continuous, and the other of the wavelength-shifting materials is non-continuous; and the spectrum adjuster additionally comprises a non-wavelength-shifting region, adjacent the wavelength-shifting region, the non-wavelength-shifting region containing no operably-effective amount of a wavelength-shifting material.

18. The light bulb of claim 17, wherein the wavelength-shifting region comprises a phosphor material.

19. The light bulb of claim 17, wherein the wavelength-shifting region comprises a luminescent nanomaterial.

20. The light bulb of claim 17, wherein the wavelength-shifting region comprises one or more of: a conjugated polymer material, an organic fluorescent dye, and an organic phosphorescent dye.

21. The light bulb of claim 17, wherein at least one of the wavelength-shifting materials has a concentration that continuously varies with position in the wavelength-shifting region.

22. The light bulb of claim 17, wherein at least one of the wavelength-shifting materials has a thickness that continuously varies with position in the wavelength-shifting region.

23. The light bulb of claim 17, wherein the spectrum adjuster comprises an additional region of wavelength-shifting material, the wavelength-shifting material in the additional wavelength-shifting region having a continuously varying wavelength-shifting property based on position in the additional region.

24. The light bulb of claim 23, wherein the wavelength-shifting material in the additional wavelength-shifting region produces a different spectrum adjustment than the wavelength-shifting materials in the wavelength-shifting region.

25. The light bulb of claim 17, wherein:

the spectrum adjuster comprises an additional wavelength-shifting region of wavelength-shifting material, the wavelength-shifting material in the additional wavelength-shifting region having a continuously varying wavelength-shifting property based on position in the additional wavelength-shifting region; and the non-wavelength-shifting region is between the wavelength-shifting region and the additional wavelength-shifting region.

26. The light bulb of claim 17, wherein:

the light emitting device is a light emitting device emitting light with no operably-effective intensity at wavelengths greater than 500 nm; and the spectrum adjuster converts the light from the light emitting device to broad-spectrum visible light.

27. The light bulb of claim 17, wherein the light emitting device is a broad-spectrum light emitting device in the visible spectrum.

28. The light bulb of claim 17, wherein the light emitting device is a solid state light emitting device.

29. The light bulb of claim 17, wherein the other of the wavelength-shifting materials comprises dots of wavelength-shifting material.

30. The light bulb of claim 29, wherein the dots of wavelength-shifting material change in density with position.

31. The light bulb of claim 29, wherein the dots of wavelength-shifting material change in size with position.

32. The light bulb of claim 29, wherein the dots of wavelength-shifting material change in thickness with position.

33. The light bulb of claim 17, wherein one of the wavelength-shifting materials comprises triangular elements of wavelength-shifting material.

* * * * *